US006588349B1

(12) United States Patent
Ahtila et al.

(10) Patent No.: US 6,588,349 B1
(45) Date of Patent: Jul. 8, 2003

(54) SYSTEM FOR THE DRYING OF DAMP BIOMASS BASED FUEL

(76) Inventors: Pekka Ahtila, Otakaari 4 P.O. Box 4100, Teknillinen Korkeakoulu (FI), 02015 TKK; Jukka-Pekka Spets, Sähkömiehentie 4 P.O. Box 4400, Teknillinen Korkeakoulu (FI), 02015 TKK ( * ) Notice: Subject to any disclaimer, the term of this patent is extended or adjusted under 35 U.S.C. 154(b) by 0 days.

(21) Appl. No.: 10/009,256

(22) PCT Filed: Jun. 8, 2000

(86) PCT No.: PCT/FI00/00516

§ 371 (c)(1),
(2), (4) Date: Mar. 11, 2002

(87) PCT Pub. No.: WO00/75567

PCT Pub. Date: Dec. 14, 2000

(30) Foreign Application Priority Data

Jun. 8, 1999 (FI) ..... 991304

(51) Int. Cl.[7] ..... F23G 5/04; F23B 7/00

(52) U.S. Cl. ..... 110/224; 110/342; 110/204; 110/225; 110/234; 110/243; 110/302; 110/303; 110/304

(58) Field of Search ..... 110/203, 204, 110/206, 211, 218, 219, 224, 233, 234, 235, 243, 244, 245, 301, 302, 303, 304, 342, 344, 225, 295, 296

(56) References Cited

U.S. PATENT DOCUMENTS

| | | | | | |
|---|---|---|---|---|---|
| 2,015,051 | A | * | 9/1935 | Baird | 110/15 |
| 2,063,630 | A | * | 12/1936 | Schilling | 110/15 |
| 2,147,151 | A | * | 2/1939 | Connolly | 110/12 |
| 3,303,798 | A | * | 2/1967 | Kartinen et al. | 110/1 |
| 3,926,129 | A | * | 12/1975 | Wall | 110/7 B |
| 4,015,546 | A | * | 4/1977 | Paules | 110/8 A |
| 4,059,060 | A | * | 11/1977 | Gambs et al. | 110/1 J |
| 4,089,277 | A | * | 5/1978 | Paul | 110/204 |
| 4,388,875 | A | | 6/1983 | Hirose | |
| 4,507,127 | A | * | 3/1985 | Hirose | 48/89 |
| 4,635,379 | A | | 1/1987 | Kroneld | |
| 4,656,972 | A | * | 4/1987 | Shimoda | 122/4 D |
| 5,146,857 | A | * | 9/1992 | Spliethoff et al. | 110/234 |
| 5,673,634 | A | * | 10/1997 | Karger et al. | 110/234 |
| 5,752,452 | A | * | 5/1998 | Leger | 110/346 |
| 6,098,553 | A | * | 8/2000 | Oksanen et al. | 110/224 |
| 6,237,511 | B1 | * | 5/2001 | Honkasalo | 110/342 |

FOREIGN PATENT DOCUMENTS

| | | | | |
|---|---|---|---|---|
| DE | 44 31 564 A1 | | 1/1996 | |
| DE | 196 35 360 A1 | | 2/1998 | |
| FI | WO 93/11388 | * | 6/1993 | F23C/11/02 |
| GB | 1 531 890 | | 11/1978 | |
| SE | 460 149 | | 9/1989 | |

* cited by examiner

*Primary Examiner*—Ira S. Lazarus
*Assistant Examiner*—K. B. Rinehart
(74) *Attorney, Agent, or Firm*—Young & Thompson

(57) ABSTRACT

System for drying a damp biofuel, includes a boiler (1) for combustion of the fuel. Further, the system includes a first heat drying chamber (2), a drying gas flow (3) heated by the thermal energy of the combustion gases from the boiler and/or by steam, the gas flow being passed into the first heat drying chamber, and a fuel supply (4) for passing the fuel into the first heat drying chamber. The system includes a second heat drying chamber (5), an intermediate heating unit (6) for heating the drying gas flow before the second heat drying chamber, an intermediate supply (7) for passing the fuel from the first heat drying chamber into the second heat drying chamber, a boiler supply (8) for passing the fuel from the final heat drying chamber into the boiler and an outlet (9) for passing the flow of drying gas from the final heat drying chamber into the boiler.

13 Claims, 1 Drawing Sheet

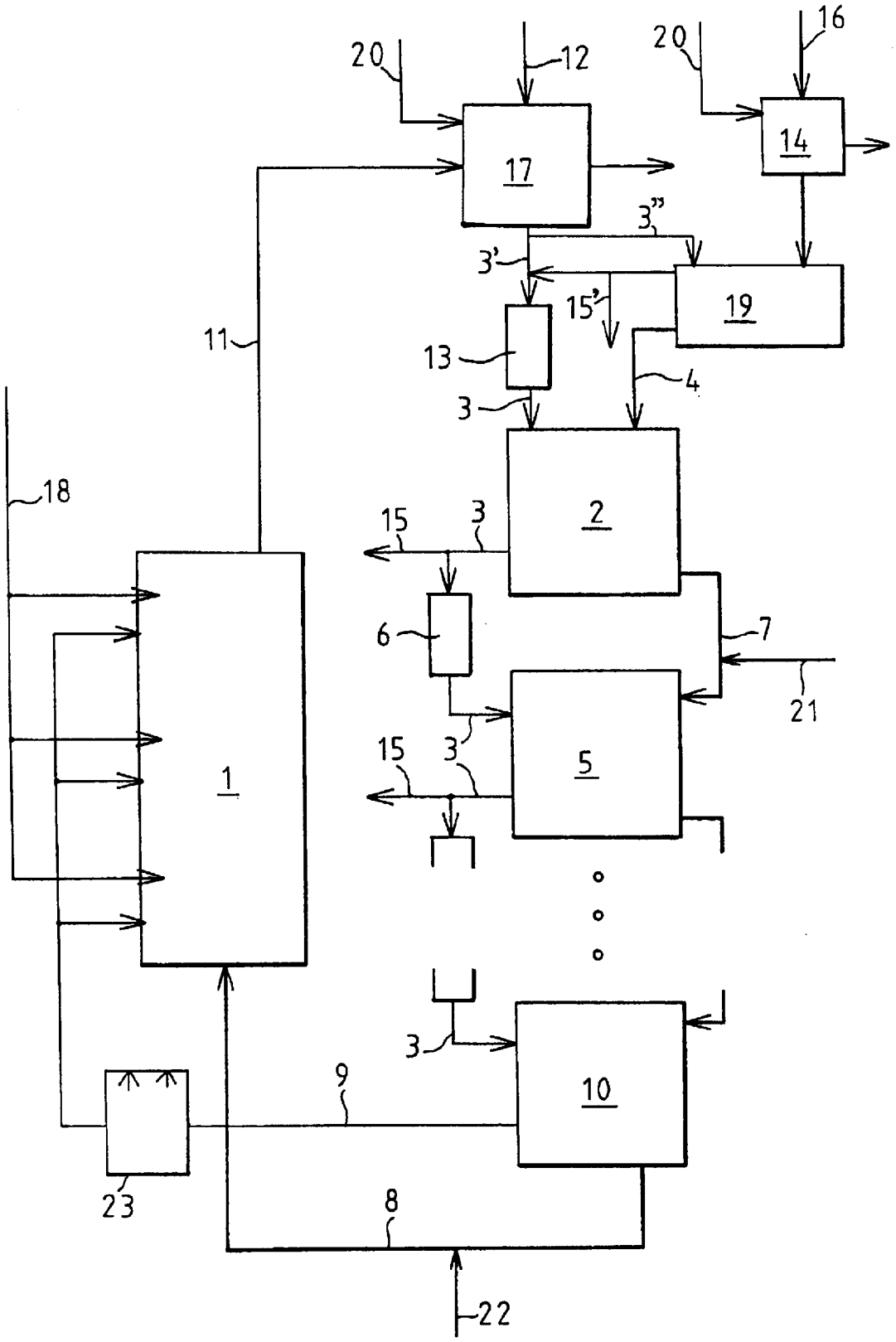
20
12
20
16
17
14
3"
3'
15'
19
11
13
4
3
18
2
15
3
6
7
21
15
3
5
1
3
10
9
23
8
22

SYSTEM FOR THE DRYING OF DAMP BIOMASS BASED FUEL

The present invention relates to a system as defined in the preamble of claim 1.

As is known, homogenization of a biofuel, such as reduction of its moisture content, equalization of vapor tension differences of different organic compounds and reduction of particle size, promotes the combustion of the fuel when burned, increases steam production in a boiler and reduces the amount of waste gas emissions produced in the combustion process. Dried solid wood material produced by a drying process using e.g. a flue gas drier or a vacuum drier allows wood material not fit for use in the production process of a pulp and paper mill to be utilized in energy production instead of being transported to a dump area. Thus, dumping costs are reduced, and so are nitrogen emissions into the atmosphere from waste transporting vehicles using fossil fuels. Moreover, fluidized bed combustion does not require the use of auxiliary fossil fuels as are otherwise needed for the combustion of damp fuels, or the amount of these fossil auxiliary fuels is substantially reduced as the wood-based fuel has been dried and burns without problems.

However, previously known drying systems, i.e. flue gas driers and vacuum driers, have certain drawbacks. So far, the main purpose of the drying and combustion of damp biomass has been to get rid of damp mass that cannot be used as raw material for anything. Thus, damp mass has been dried using various kinds of waste heat, such as flue gases, obtained from different processes, without properly considering the effect of the fuel on the process as a whole. For instance, drying processes may use large amounts of warm air which is blown out into outer air in a humid state. Thus, both solid and gaseous impurities, odors as well as organic or solid compounds are emitted into the atmosphere from the drying process.

The object of the invention is to eliminate the problems referred to above. A specific object of the invention is to disclose a new type of system that will allow a more effective utilization of a damp biofuel as well as a definite reduction in the amount of emissions into the environment as compared with prior-art solutions.

As for the features characteristic of the invention, reference is made to the claims.

The system of the invention comprises a boiler, preferably a fluidized bed boiler, in which a biofuel is burned in order to recover and utilize the energy contained in it. The system of the invention is based on multi-stage drying, i.e. at least two successive separate heat drying chambers and drying stages. Thus, according to the invention, the system comprises a first heat drying chamber, into which a flow of drying gas is passed and which is also provided with a fuel supply for supplying a fuel to be dried into the first heat drying chamber. In addition, the system comprises at least a second heat drying chamber and an intermediate heating unit, the latter being used to heat the flow of drying gas between the heat drying chambers. The system also comprises an intermediate supply for passing the fuel from the first heat drying chamber into the second heat drying chamber. Thus, the system of the invention has at least two and preferably more than two separate heat drying chambers in series, i.e. in cascade so that substantially the same drying gas flow is heated during each passage between chambers. In addition, the system of the invention comprises a boiler supply for passing the fuel from the last heat drying chamber into a boiler, and an outlet for passing the flow of drying gas from the last heat drying chamber into the boiler, preferably into different combustion zones in the boiler.

In an embodiment of the invention, the drying gas flow is also cooled between the heat drying chambers, thus allowing it to be dehumidified before being heated.

The system of the invention is based on the fundamental idea that the higher the temperature of the drying gas flowing into a drying stage, the smaller is the volume flow of drying gas needed. Thus, the smaller the volume flow of the drying gas supplied into the heat drying chamber, the easier will it be to conduct the more humid gas flow after the drying stage into a fluidized bed boiler where it is to be thermally oxidized. Likewise, the higher the temperature of the drying gases supplied and the lower the moisture content of the fuel supplied into the stage, the higher is the internal temperature within the drier. Thus, in the system of the invention, preliminary and intermediate heating stages are used to minimize the drying gas flows and to enable their effective thermal treatment in the boiler.

Similarly, in the system of the invention, the higher the temperature of the drying gases supplied into individual heat drying stages, the larger is the amount of organic compounds evaporated in consequence of steam distillation from the fuel being dried. Therefore, the gases leaving the drying stage also have a certain thermal value in combustion. As a result of the multi-stage preliminary and intermediate heating of the drying gas flow, the water-binding capacity, i.e. the adiabatic water-binding capacity of the drying gases is increased as compared with passing hot drying gases of 100–500° C. into a single-stage fuel drier. This is part of the reason behind the fact that the higher the temperature of the drying gases supplied into the drier, the more is the volume flow needed in the drier reduced.

The drying gas flow used in the system of the invention may consist of combustion gases, air heated by combustion gases or a suitable mixture of combustion gases and air. A mixture of combustion gas and air is advantageous because it dilutes the oxygen content of the drying gas leaving the last drying stage. This makes it easier to create under-stoichiometric conditions with respect to oxygen of the combustion air in the fluidized bed of the fluidized bed boiler burning the dry fuel.

The system preferably comprises a pre-heating unit for pre-heating of the drying gas flow before the first heat drying chamber. The pre-heating unit may consist of a unit in which air is heated by combustion gases or it may be a unit in which relatively hot combustion gases or mixture of combustion gases and air are/is heated further using e.g. bled steam.

In a preferred case, the pressure in one or more drying stages, e.g. in the first drying stage, is regulated or is maintained at a given level in relation to the atmospheric pressure. Preferably a pressure below atmospheric is used, but normal atmospheric pressure and a pressure above atmospheric are also possible in some cases, depending on the quality and moisture content of the fuel to be treated.

In an embodiment of the invention, the system comprises a fuel pre-heating unit disposed before the first heat drying chamber. Thus, the fuel can be pre-heated and pre-dried at a relatively low temperature, e.g. 50–80° C., before the actual heat drying process. For such low-temperature pre-heating and pre-drying, it is possible to use any flow of exhaust heat released from the process or otherwise difficult to utilize. The use of a fuel pre-heating unit is almost always profitable because the process generally produces various secondary energy flows that can be used to raise the temperature of the fuel and reduce its moisture content without substantial additional energy costs.

In an embodiment of the invention, the drying gas flow coming out of a heat drying chamber comprises an intermediate outlet placed before an intermediate heating unit, said outlet serving to remove a portion of the relatively humid gas flow from the drying circulation. Depending on the temperature and moisture content of the gas flow portion to be removed and on the amount of organic compounds contained in it, said gas flow portion can be passed either into outer air, into the boiler for use in combustion or into a pre-heating unit for recovery of the heat contained in it.

In the drying gas flow, it is further possible to use various separators, e.g. a cyclone, for removing e.g. solid particles and moisture in the form of an aerosol from the drying gas flow, in addition to the possibility of reducing moisture by cooling the flow as described above. Separators are preferably used after each drying stage. It is also possible to treat the drying gas flow in a condensing scrubber to remove extra moisture from the gas flow before it is passed into the boiler. The condensed water can then be passed into the wastewater treatment system of the plant.

The boiler used in the system of the invention is preferably a known type of fluidized bed boiler into which humid drying gases produced in the system can be easily passed for combustion. As drying apparatus, it is possible to use solid bed, fluidized bed or circulating mass drier applications. The system of the invention uses two or more driers connected in series, i.e. in cascade, their number depending on the operating environment in question and the drying results aimed at. The capacity of the system can be readily increased by using a parallel configuration of a required number of series connected drying apparatus in themselves corresponding to the system described above.

As compared with prior art, the system of the invention provides significant advantages. The volume flows of the required drying gases are small as compared with prior-art solutions, allowing their adiabatic water-binding capacity to be significantly improved via preliminary and intermediate heating. Similarly, due to their small volume, said flows can be easily fitted in different stages among the combustion air passed into a fluidized bed boiler. However, the drying gases are preferably not passed directly into the boiler furnace to avoid energy losses; instead, they are supplied into boiler areas where the combustion gases have a temperature of the order of 750–800° C., which is sufficient for thermally oxidizing the organic compounds contained in the drying gases, producing carbon dioxide.

Although the exhaust gases from the system for drying a damp fuel are taken into the boiler and thermally oxidized, which significantly reduces the combustion gas emissions, the amount of fresh steam produced in the boiler is larger than the corresponding values for a mere boiler using damp fuel without a system according to the invention for drying damp fuel outside the furnace.

The increase in the thermal value of the fuel achieved by the system of the invention is sufficient to compensate for the energy consumed in the treatment of the drying gases (pre-heating, intermediate heating and heating of the drying gases inside the boiler to the combustion temperature). A further advantage is that the drying gases need not be taken to boiler furnace areas where the temperature exceeds 750–800° C. because in this way the system avoids losing too much of the energy of the combustion gases which has to be utilized for steam production in the boiler.

Thus, in-the system of the invention, the net energy production in fluidized bed combustion is increased, combustion gas emissions are decreased and condensate emissions are minimized when the minimum temperatures of the drying gases flowing out from different drying stages of the combustion gas drier are in the range of 95–100° C.

The multi-stage drying system of the invention is applicable for use in conjunction with boilers of different categories regarding fuel efficiency, including both small plants and plants of over 100 MW. However, the increase in the net combustion efficiency achieved by the drying system described is the greater the larger is the power plant boiler and the lower is the fuel dampness value aimed at.

Using the system of the invention for immediate drying of a damp fuel, the period of storage of the fuel is shortened and the loss of its thermal value due to rotting is avoided. In addition, when a fluidized bed boiler is operated at net energy production levels corresponding to those achieved earlier by burning damp fuel, the mass flow of damp fuel at the input is reduced, which is of great importance in reducing the emissions from the combustion process.

As there are generally large variations in the quality and dampness values of different biofuels, the system of the invention provides the advantage that the multi-stage drying process, being additionally easy to regulate, balances these variations, permitting smooth operation of the boiler.

In the following, the invention will be described in detail with reference to the attached drawing, which presents diagram representing a system according to the invention.

The system for drying a biofuel presented in the figure is used in conjunction with a fluidized bed boiler 1. The system comprises a first heat drying chamber 2, a second heat drying chamber 5 and a final heat drying chamber 10, in other words, the system may comprise two or more heat drying chambers connected in series. The maximum moisture content of the fuel supplied into the system is about 60% by weight and the fuel is first fed into a pre-heating unit 14, where the damp and possibly cold fuel is heated by secondary energy flows of the process, various warm flow-offs released from the process.

From the pre-heating unit 14, the fuel is passed into a cold drying stage 19. The cold drying stage 19 works at a relatively low supply temperature of the drying medium, preferably in the range of 80–100° C. The drying medium used may consist of combustion gas, a mixture of combustion gas and air, or air. The fuel supplied from the cold drying stage 19 to the fuel intake 4 has a dampness value of the order of 30–40% by weight. Another possibility is that no cold drying stage 19 is used at all; instead, the fuel is fed directly via the pre-heating unit 14 and the fuel input 4 into the first heat drying chamber 2.

Supplied into the first heat drying chamber 2 is also a drying gas flow 3, which is obtained from the combustion gases 11 of the boiler and from outer air 12 via a heat exchanger or gas flow mixer 17. In other words, the drying gas flow 3 may consist of combustion gas 11 alone, or it may consist of a mixture of combustion gas and air, or of mere air heated by hot combustion gases from the boiler. Depending on the temperature of the drying gas flow, it may be additionally heated in the pre-heating unit 13 using combustion gases at different temperatures or low-pressure steam. Consequently, the drying gas flow 3 supplied into the first heat drying chamber 2 is at a temperature in the range of 150–500° C.

The drawing shows two alternatives for routing the drying gas flow 3 between the mixer 17 and the pre-heating unit 13. If no cold drying stage 19 is used in the system, then the drying gas flow 3' can be passed directly from the mixer 17 into the pre-heating unit 13. On the other hand, if the system does use a cold drying stage 19, then the drying gas flow 3" is routed into the cold drying stage 19, and the drying gas outlet from the cold drying stage can be provided with an intermediate outlet 15' leading either into the boiler or into the atmosphere outside the system. The rest of the flow is then passed into the first heat drying chamber 2 via the pre-heating unit 13, unless the entire flow is passed out via the intermediate outlet 15'.

From various secondary energy flows 20 occurring in the processes, heat was passed into the fuel pre-heating unit 14. Corresponding outlet flows and waste heat 20 can also be used in conjunction with a heat exchanger or mixer 17 e.g. to heat an air supply 12 taken from outside.

The drying gas 3 flowing out of the first heat drying chamber 2 has a temperature in the range of 95–100° C. A portion of this humid gas flow can be removed via an intermediate outlet 15 and the portion of the drying gas flow needed in the second heat drying chamber 5 is heated in an intermediate heating unit 6 to a temperature of 150–500° C. before being passed into the second heat drying chamber 5. If an intermediate outlet 15 is used, the gas flow removed from the process can be taken to a suitable point in the boiler or it may be passed out from the system, e.g. into the atmosphere. Via an intermediate supply 7, the partially dried fuel, having a moisture content of e.g. 20–40% by weight, is passed into the second heat drying chamber.

The number of heat drying chambers thus connected in series may be two or more, depending on the temperatures, mass and gas flow volumes and the moisture of the fuel to be dried as well as the final moisture level aimed at. Successive heat drying stages or some of them may be identical to each other, in other words, they may have the same temperature and they may employ the same heat source and steam pressure. Likewise, they may be implemented so as to form steps with the temperature and pressure rising from one stage to the next. It is further possible that the temperatures, steam pressures as well as the hear sources used are adjustable and freely selectable.

From the final heat drying chamber 10, the fuel is passed via a boiler supply 8 into the fluidized bed boiler 1. The moisture value X of the fuel is in the range of $0<X<15–20\%$ by weight while the final moisture value of the fuel is in balance with the partial pressure of water in the drying gas.

The gases at 95–100° C. flowing out of the last heat drying chamber are passed via an outlet 9 into the fluidized bed boiler 1 in a phased manner. In other words, a portion of the drying gas flow is taken into the bed fluidization section of the fluidized bed boiler, another portion into the freeboard of the fluidized bed and into the secondary air register, and the rest into the tertiary air stage. By distributing the drying gas flow in this manner to different parts of the boiler and adjusting it as required in each case, the combustion gases emitted from the boiler are made as clean as possible and the organic compounds produced in the drying process are completely oxidized. In a corresponding manner, preferably a phased supply 18 of combustion air into the boiler 1 is employed. As for the supply 18 of combustion air, the fluidized bed is maintained in under-stoichiometric conditions as regards the oxygen needed for the combustion, thus preventing the temperature of the fluidized bed from rising to an excessive level as a result of the drying of the fuel. Thus, at least a portion and possibly all of the combustion air supplied into the boiler 1 is passed through the system and, if necessary, a portion 18 of the combustion air can be taken from outer air.

Before being passed into the boiler, the humid gases are preferably treated by a condensing scrubber 23, in which the gas flow is dried in a known manner to eliminate extra moisture. The condensed water can be taken into the waste water treatment system of the plant.

The high supply temperatures of the drying gas flows used in the system reduce the volume flow of the drying gas fed into an individual stage, which has a very great importance as regards further thermal treatment of the drying gases leaving the system. The drying gases leaving individual drying stages have a water vapor content that exceeds their moisture content at supply. Re-condensation of water and certain organic compounds is prevented by maintaining a minimum exit gas temperature of the order of 95–100° C.

A system according to the invention as presented in the drawing, the system being divided into different heat drying chambers or zones, is preferably regulated by computing a mass and energy balance essentially continuously for each stage and, based on said balance, regulating the need for additional heating and/or cooling in each stage as well as the gas flow to be let out in accordance with a pre-designed model.

The system can also be regulated by using an auxiliary fuel supply 21 between the heat drying chambers. This allows e.g. drier fuel to be added into the process only after moister fuel has been partially dried e.g. to the moisture level of the fuel to be added. It is further possible to use fuel blending, i.e. to provide the system with a post-supply 22 in which the fuel passed through the system is blended with some other fuel added into it. Thus, the post-supply 22 allows further adjustment of the moisture values of the fuel fed into the boiler. At this point it is also easy to add into the process sufficiently dry fuel that needs no drying at all.

In the foregoing, the invention has been described by way of example with reference to the attached drawing while different embodiments of the invention are possible in the scope of the inventive idea defined in the claims.

What is claimed is:

1. System for drying a damp biofuel, said system comprising a boiler (1), preferably a fluidized bed boiler, for combustion of the fuel, a first heat drying chamber (2), a drying gas flow (3) heated by the thermal energy of the combustion gases from the boiler, secondary energy obtained from waters used in the processes and/or by steam, said gas flow being passed into the first heat drying chamber, and a fuel supply (4) for passing the fuel into the first heat drying chamber, characterized in that the system comprises a second heat drying chamber (5), an intermediate heating unit (6) for heating the drying gas flow before the second heat drying chamber an intermediate supply (7) for passing the fuel from the first heat drying chamber into the second heat drying chamber, a boiler supply (8) for passing the fuel from the final heat drying chamber into the boiler and an outlet (9) for passing the flow of drying gas from the final heat drying chamber into the boiler.

2. System as defined in claim 1, characterized in that the system comprises at least three successive heat drying chambers (2, 5, 10) with intermediate heating units (6) and intermediate fuel supplies (7) between them.

3. System as defined in claim 1, characterized in that the drying gas flow (3) consists of combustion gases (11) obtained from the boiler, air (12) or a mixture of these.

4. System as defined in claim 1, characterized in that the system comprises a pre-heating unit (13) for pre-heating the drying gas flow (3) before the first heat drying chamber (2).

5. System as defined in claim 1, characterized in that the system comprises a pre-heating unit (14) for pre-heating the fuel before the first heat drying chamber (2).

6. System as defined in claim 1, characterized in that the drying gas flow (3) coming from the heat drying chamber (2, 5) comprises an intermediate outlet (15) before the intermediate heating unit (6) for removing a portion of the gas flow from the drying circulation.

7. System as defined in claim 6, characterized in that the intermediate outlet (15) passes the gas flow removed into outer air, into the boiler for combustion or into one of the pre-heating units.

8. System as defined in claim 1, characterized in that the drying gas flow comprises a separator, such as a cyclone, for removing a portion of the moisture and particles from the gas flow.

9. System as defined in claim 1, characterized in that the heat needed in the pre-heating unit and/or intermediate heating unit for heating the drying gas flow is provided using bled steam from a turbine driven by the boiler or using hot combustion gases obtained from the boiler.

10. System as defined in claim 1, characterized in that the system comprises an auxiliary fuel supply (21) between the heat drying chambers.

11. System as defined in claim 1, characterized in that the system comprises a fuel post-supply (22) for blending the treated fuel with untreated fuel before the fuel is passed into the boiler.

12. System as defined in claim 1, characterized in that the system comprises pressure regulation means for regulating the pressure in the heat drying chamber or maintaining it at a given level.

13. System as defined in claim 4, characterized in that the heat needed in the pre-heating unit and/or intermediate heating unit for heating the drying gas flow is provided using bled steam from a turbine driven by the boiler or using hot combustion gases obtained from the boiler.

* * * * *